US006688877B1

(12) United States Patent
Draper et al.

(10) Patent No.: US 6,688,877 B1
(45) Date of Patent: Feb. 10, 2004

(54) LANTERN AND FUEL SYSTEM AND METHOD

(76) Inventors: Diana Clifton Draper, 9516 Lake Dr., New Port Richey, FL (US) 34654; George E. Draper, 9516 Lake Dr., New Port Richey, FL (US) 34654; Charles A. Stokes, 1001 Arbor Lake Dr., Naples, FL (US) 34110-7082

( * ) Notice: Subject to any disclaimer, the term of this patent is extended or adjusted under 35 U.S.C. 154(b) by 0 days.

(21) Appl. No.: 10/389,896

(22) Filed: Mar. 17, 2003

(51) Int. Cl.[7] ..... F23D 11/42; F23D 11/44; F23D 11/46; F23D 14/30

(52) U.S. Cl. ..... 431/104; 431/107; 431/227; 431/228; 431/218

(58) Field of Search ..... 431/207, 11, 229, 431/103, 104, 105, 106, 107, 108, 109, 110, 228, 344, 218, 219, 225, 227; 362/179

(56) References Cited

U.S. PATENT DOCUMENTS

| | | | | | |
|---|---|---|---|---|---|
| 1,003,329 | A | * | 9/1911 | Burton | |
| 1,381,080 | A | * | 6/1921 | Cleary | 431/104 |
| 1,720,932 | A | * | 7/1929 | Terrell, Jr. | 431/107 |
| 1,910,163 | A | * | 5/1933 | Hogan | 431/210 |
| 2,263,659 | A | * | 11/1941 | Tullis | 362/179 |
| 2,402,138 | A | * | 6/1946 | Hebard | 239/116 |
| 2,431,665 | A | * | 11/1947 | Tullis | 431/107 |
| 2,463,830 | A | * | 3/1949 | Tullis | 431/123 |
| 2,465,572 | A | * | 3/1949 | Bramming | 431/344 |
| 2,664,729 | A | * | 1/1954 | Bramming | 431/210 |
| 2,671,504 | A | * | 3/1954 | Anderson | 431/123 |
| 3,376,100 | A | * | 4/1968 | Palmer et al. | 431/36 |
| 3,529,911 | A | * | 9/1970 | Townsend | 431/107 |
| 3,773,458 | A | * | 11/1973 | Spotts | 431/156 |
| 3,804,075 | A | * | 4/1974 | Rummel | 126/258 |
| 4,029,079 | A | * | 6/1977 | Elder | 126/258 |
| RE29,457 | E | * | 10/1977 | Hastings | 431/123 |
| 4,091,795 | A | * | 5/1978 | Wells | 126/258 |
| 4,186,760 | A | * | 2/1980 | Hastings | 137/244 |
| 4,372,198 | A | * | 2/1983 | Stover et al. | 99/340 |
| 4,522,582 | A | * | 6/1985 | Curtis | 431/123 |
| 4,954,075 | A | * | 9/1990 | Francino | 431/107 |
| 5,113,843 | A | * | 5/1992 | Henry et al. | 126/77 |
| 5,836,757 | A | * | 11/1998 | Long et al. | 431/264 |
| 6,439,223 | B1 | * | 8/2002 | Draper et al. | 126/258 |

FOREIGN PATENT DOCUMENTS

| | | | | |
|---|---|---|---|---|
| FR | 2422111 | * | 11/1979 | 431/344 |
| JP | 361114004 | * | 5/1986 | 431/208 |
| JP | 363046312 | * | 2/1988 | 431/208 |
| JP | 404064802 | * | 2/1992 | 431/4 |

* cited by examiner

*Primary Examiner*—Carl D. Price
(74) *Attorney, Agent, or Firm*—Edward P. Dutkiewicz

(57) ABSTRACT

A pressure gauge subassembly, a pump subassembly, a lower skirt and cap, and an ignition bowl having an up-pipe are coupled to a fuel tank. A safety cover has a Z-shaped upward projection coupled to the lower skirt. A heat resistant glass chimney is coupled to the lower and upper skirts. A lower skirt is coupled to the glass chimney. A lantern top cap with a mixing chamber is coupled to the upper skirt. A plurality of connecting rods firmly hold and contain the glass chimney between the upper skirt and the lower skirt. A vaporizer has two warming coils and a nipple. A quantity of steel wool is wrapped around a vaporizer shaft. A J-shaped mixing tube having a wire mesh and a baffle plate is coupled to the lantern top cap. A mantel is coupled to the mixing tube. The fuel is a quantity of liquid methanol.

10 Claims, 9 Drawing Sheets

FIG 3
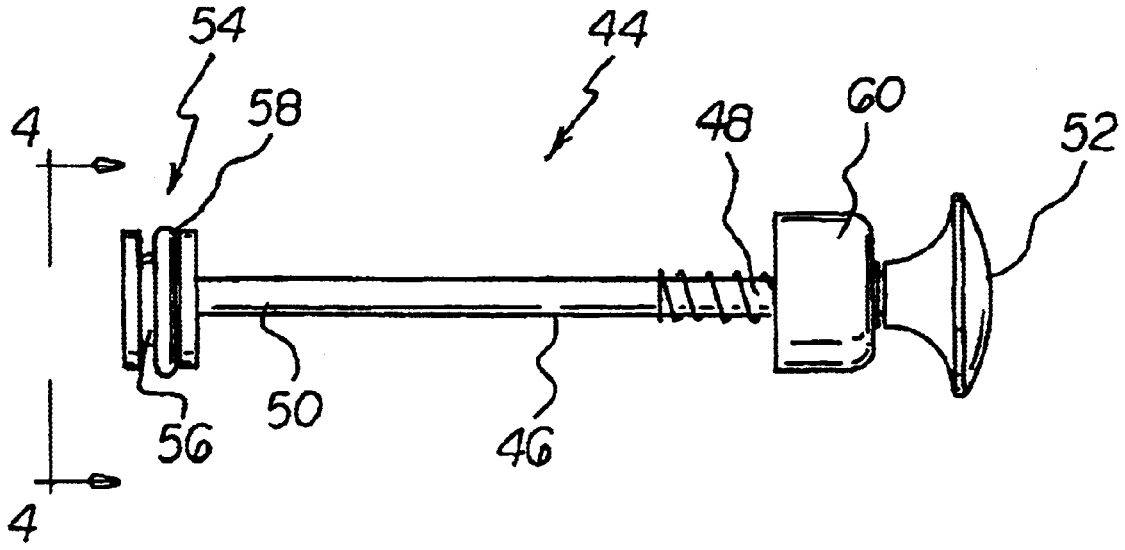
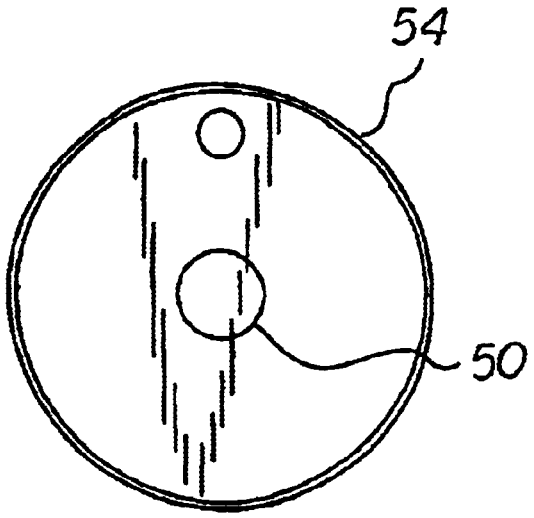
FIG 4

FIG 10
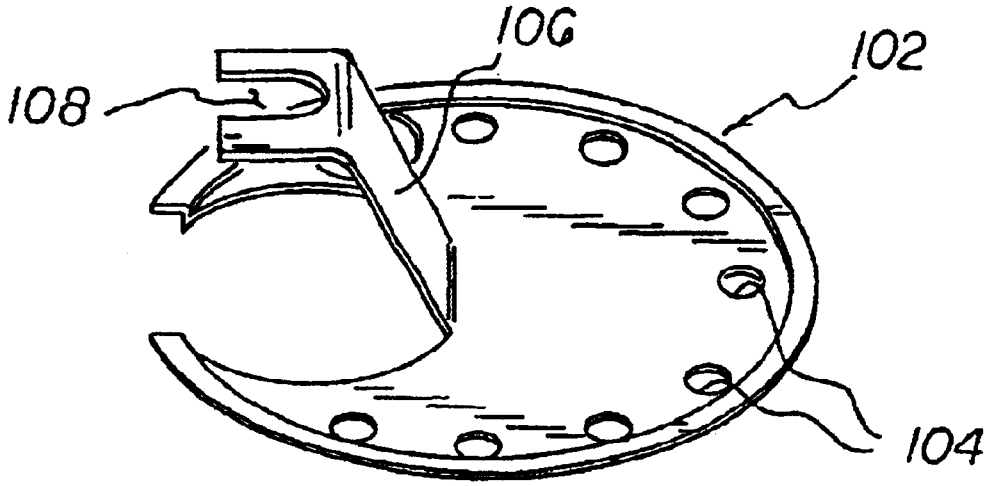
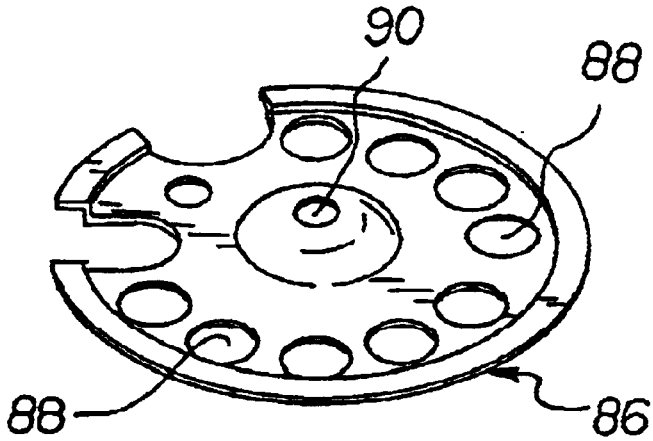
FIG 11

LANTERN AND FUEL SYSTEM AND METHOD

BACKGROUND OF THE INVENTION

1. Field of the Invention

The present invention relates to a lantern and fuel system and method and more particularly pertains to allowing a user to safely and conveniently use a liquid fuel to provide heat and light.

2. Description of the Prior Art

The use of lantern and fuel systems of known designs and configurations is known in the prior art. More specifically, lantern and fuel systems of known designs and configurations previously devised and utilized for the purpose of providing heat and light are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,773,458 to Spotts discloses a portable convertible mantle-lantern, camp stove. U.S. Pat. No. 3,804,075 to Rummel discloses attachments for lanterns. U.S. Pat. No. 4,029,079 to Elder discloses a lantern stove device attachment. U.S. Pat. No. 4,372,198 discloses a lantern hot plate. U.S. Pat. No. 4,091,795 discloses a cooking adapter. U.S. Pat. No. 4,954,075 discloses a lantern head for backpacker's stove. U.S. Pat. No. 5,113,843 to Henry et al. discloses a combustion device for stoves and fireplaces. Lastly, U.S. Pat. No. 6,439,223 issued Aug. 27, 2002, to Draper et al. discloses a lantern system.

While these devices fulfill their respective, particular objectives and requirements, the aforementioned patents do not describe a lantern and fuel system and method that allows allowing a user to safely and conveniently use a liquid fuel to provide heat and light.

In this respect, the lantern and fuel system and method according to the present invention substantially departs from the conventional concepts and designs of the prior art, and in doing so provides an apparatus primarily developed for the purpose of allowing a user to safely and conveniently use a liquid fuel to provide heat and light.

Therefore, it can be appreciated that there exists a continuing need for a new and improved lantern and fuel system and method to safely and conveniently use a liquid fuel to provide heat and light. In this regard, the present invention substantially fulfills this need.

SUMMARY OF THE INVENTION

In view of the foregoing disadvantages inherent in the known types of lantern and fuel systems of known designs and configurations now present in the prior art, the present invention provides an improved lantern and fuel system and method. As such, the general purpose of the present invention, which will be described subsequently in greater detail, is to provide a new and improved lantern and fuel system and method which has all the advantages of the prior art and none of the disadvantages.

To attain this, the present invention essentially comprises a fuel tank fabricated of metal with a flat bottom and a hemispherically shaped side wall thereby forming a cavity. A pressure gauge opening and pressure gauge stub with a male threaded outward end are provided in the side wall. The side wall also has a pump opening and pump stub with a male threaded outward end. An associated check valve and a vaporizer opening into the cavity of the fuel tank are contained within the pump stub. There is also a tank filling opening and an associated threaded filling stub.

A pressure gauge subassembly has a readable indicator and a pressure bleed-off screw and a threaded collar to couple the pressure gauge subassembly to the pressure gauge stub of the fuel tank.

A pump subassembly has a shaft. The upper end of the shaft has a gripping handle. The lower end has a pump portion with a beveled seat and an O-ring associated thereto to provide a seal for pumping. The pump subassembly is positioned in the pump stub of the fuel tank between the cavity of the tank and the end of the pump stub. The shaft of the pump passes through a threaded stub cap which is coupled to the pump stub of the tank.

A hollow tubular lower skirt has an outer surface and an inner surface with a wall thickness there between. The lower skirt has a continuous bottom portion of a first diameter. The bottom portion has a valve slot. The lower skirt also has a multi-perforated upper portion of a second diameter with a flare. The upper portion has an ignition slot and a valve slot there through. The flared upper portion has a lip with a plurality of upwardly directed connecting rod holes there through.

A flat round disk-like planar lower skirt cap has a plurality of holes there through and is sized to fit within the first diameter of the lower skirt. The cap has a central screw hole for coupling with the tank.

A generally U-shaped ignition bowl has an up-pipe in a hollow tube configuration. The upper end of the pipe is beveled and an aperture is provided into the tube at the lower end of the pipe. The pipe is coupled to the ignition bowl at the lower end and the ignition bowl is coupled to the cap.

A round flat disc-like safety cover has a plurality of holes there through. The safety cover has a diameter sized to fit securely within the second diameter of the lower skirt. A Z-shaped upward projection is coupled to the cover. The projection has a notch at an uncoupled end.

A round tubular heat resistant glass chimney has a first length with an outside diameter sized to be received and securely contained within the inside of the flare of the lower skirt.

A hollow tubular upper skirt has an outer surface and an inner surface and a wall thickness there between. The upper skirt has a flared lower portion with a lip. The lip has a plurality of downwardly oriented connecting rod holes there through. The upper portion has a plurality of handle coupling threaded studs at opposite sides. The upper portion of the upper skirt has a third diameter larger than the first diameter and smaller than the second diameter. The upper portion has a plurality of upwardly oriented slots there through. The upper skirt has a central opening at the uppermost extent having a diameter of approximately the first diameter.

A lantern top cap has a hollow tubular lower portion with a plurality of openings there through and an outwardly flared upper portion with a flat top. The lower portion has a mixing chamber and couples with the upper skirt.

A plurality of connecting rods comprise a shaft. Each end has a male thread and an associated nut. The rods are sized to be received into the connecting rod holes of the lower skirt and the upper skirt. The rods couple to the upper and lower skirt with the nuts being tightened on the rods to firmly hold and contain the glass chimney there between.

A vaporizer has a lower subassembly and an upper subassembly. The lower subassembly has an upper end and a lower end. The lower end has a tubular configuration and projects downward into the tank cavity through the vaporizer opening in the tank to a point near the bottom of the tank cavity. A valve housing is coupled to the upper end. The upper end of the lower subassembly has a coupling means to couple the lower subassembly to the tank. The lower end has a check valve at its lowermost extent. The upper end has a T-shaped tubular body with an upper extension and a lower extension and a side end control stub located to protrude through the valve slot of the lower skirt. The upper extension has a flare coupling nut. The lower subassembly has a handle and a handle shaft. The handle shaft has a handle end and an actuating end. The shaft is coupled to the control stub with the handle shaft running the length of the control stub. The shaft has a protrusion at the actuating end. The upper vaporizer subassembly has a lower flared end with an associated coupling nut and a tubular riser and two warming coils. The warming coils have a curved tubular configuration and couple at each end of the coil with the tubular riser. The tubular riser has a first internal diameter and a second internal diameter. The uppermost extent of the upper subassembly has a female thread and an associated male threaded nipple. The nipple has an associated threaded jet needle. The nipple has an aperture of between about $^{18}/_{1000}$ inch and $^{24}/_{1000}$ inch there through centrally located and oriented in an upward direction.

A vaporizer shaft has an upper shaft and a lower shaft and a shaft connector. Each shaft is sized to fit loosely within the tubular body of the valve with the lower shaft threadedly coupling with the shaft connector and the vaporizer lower subassembly check valve and operating the valve as the handle shaft is turned. The upper shaft is threadedly coupled with the connector and the jet needle so that rotation of the knob performs one of the two operations which include the opening of the lower check valve to allow the passage of fuel and the engagement of the needle into the aperture of the nipple. A quantity of steel wool wrapped around the vaporizer shaft.

A J-shaped mixing tube has an internal diameter and an external diameter and a wall thickness there between. The tube has an internally coupled wire mesh and an internal rotatably movable baffle plate with an associated rotation shaft. The tube has a longer portion and a shorter portion. The shorter portion of the mixing tube has a baffle plate aperture with the rotatable baffle located within the internal diameter of the tube with the rotation shaft protruding through the plate aperture. The shorter portion couples with the lantern top cap between about ¾ and 2 inches from the jet aperture of the vaporizer forming a mixing chamber. The longer portion protrudes downward toward the center of the glass chimney.

A mantel is coupled to the short portion of the mixing tube and is suspended within the glass chimney. A quantity of liquid methanol is used as a fuel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lantern and fuel system and method which has all of the advantages of the prior art lantern and fuel systems of known designs and configurations and none of the disadvantages.

It is another object of the present invention to provide a new and improved lantern and fuel system and method which may be easily and efficiently manufactured and marketed.

It is further an object of the present invention to provide a new and improved lantern and fuel system which is of durable and reliable constructions.

An even further object of the present invention is to provide a new and improved lantern and fuel system and method which is susceptible of a low cost of manufacture with regard to both materials and labor, and which accordingly is then susceptible of low prices of sale to the consuming public, thereby making such lantern and fuel system and method economically available to the buying public.

Even still another object of the present invention is to provide a lantern and fuel system and method for allowing a user to safely and conveniently use a liquid fuel to provide heat and light.

Lastly, it is an object of the present invention to provide a new and improved pressure gauge subassembly, a pump subassembly, a lower skirt and cap, and an ignition bowl having an up-pipe coupled to a fuel tank. A safety cover has a Z-shaped upward projection coupled to the lower skirt. A heat resistant glass chimney is coupled to the lower and upper skirts. A lower skirt is coupled to the glass chimney. A lantern top cap with a mixing chamber is coupled to the upper skirt. A plurality of connecting rods firmly hold and contain the glass chimney between the upper skirt and the lower skirt. A vaporizer has two warming coils and a nipple. A quantity of steel wool is wrapped around a vaporizer shaft. A J-shaped mixing tube having a wire mesh and a baffle plate is coupled to the lantern top cap. A mantel is coupled to the mixing tube. The fuel is a quantity of liquid methanol.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the pump shown in FIGS. 1 and 2.

FIG. 4 is a front elevational view taken along line 4—4 of FIG. 3.

FIG. 10 is perspective view of the safety cover.

FIG. 11 is a perspective illustration of a lower skirt cap.

The same reference numerals refer to the same parts throughout the various Figures.

DESCRIPTION OF THE PREFERRED EMBODIMENT

The present invention, the lantern and fuel system 10 is comprised of a plurality of components. Such components in their broadest context include a fuel tank, a pressure gauge subassembly, a pump subassembly, a lower skirt coupled to the tank, a lower skirt cap, an ignition bowl, a safety cover, a heat resistant glass chimney, an upper skirt, a lantern top cap, a plurality of connecting rods, a vaporizer and vaporizer cap, a quantity of steel wool, a J-shaped mixing tube, a mantel and a quantity of liquid methanol. Such components are individually configured and correlated with respect to each other so as to attain the desired objective.

Figure 1:
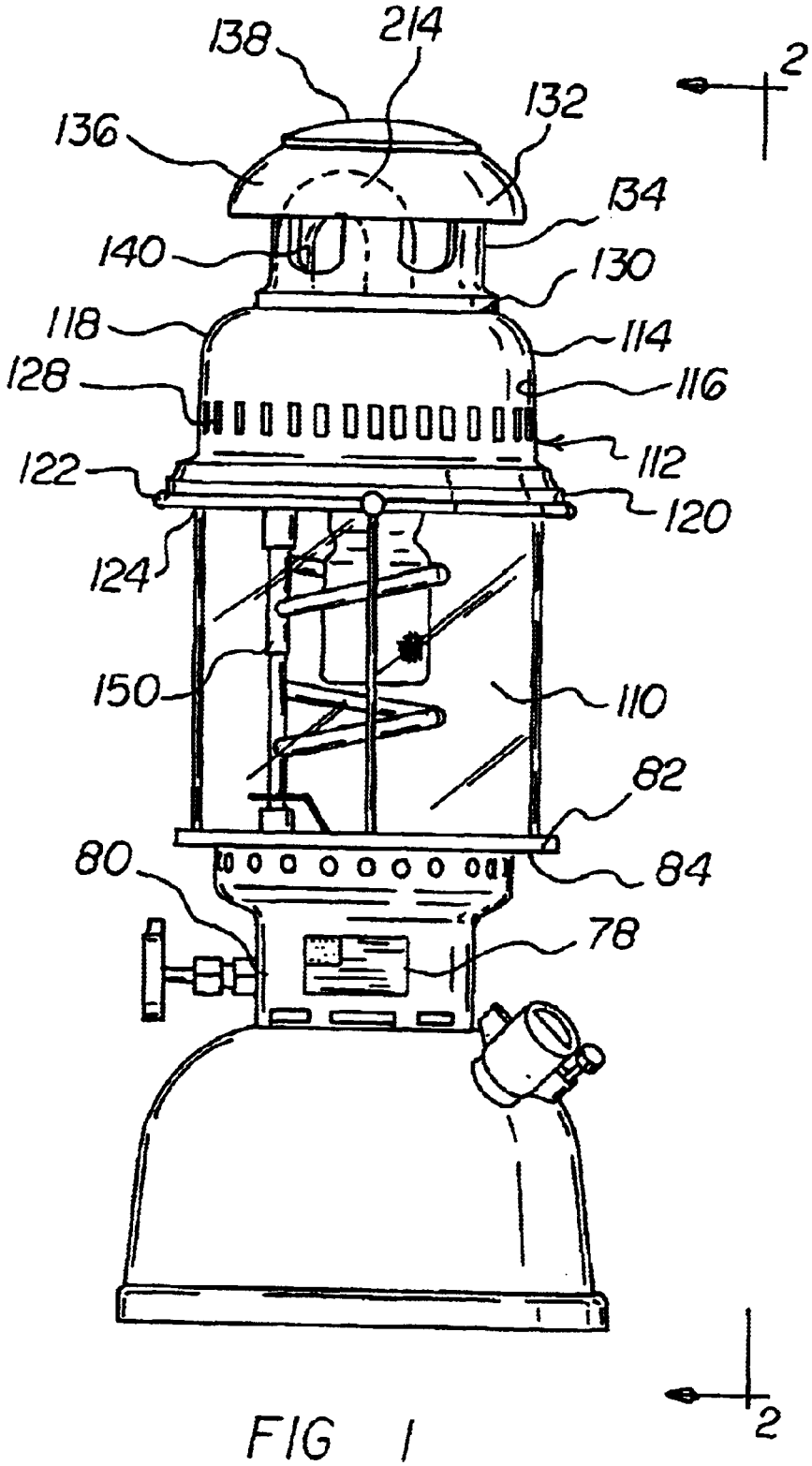
FIG. 1 is a side elevational view of a lantern and fuel system constructed in accordance with the principles of the present invention.
Figure 2:
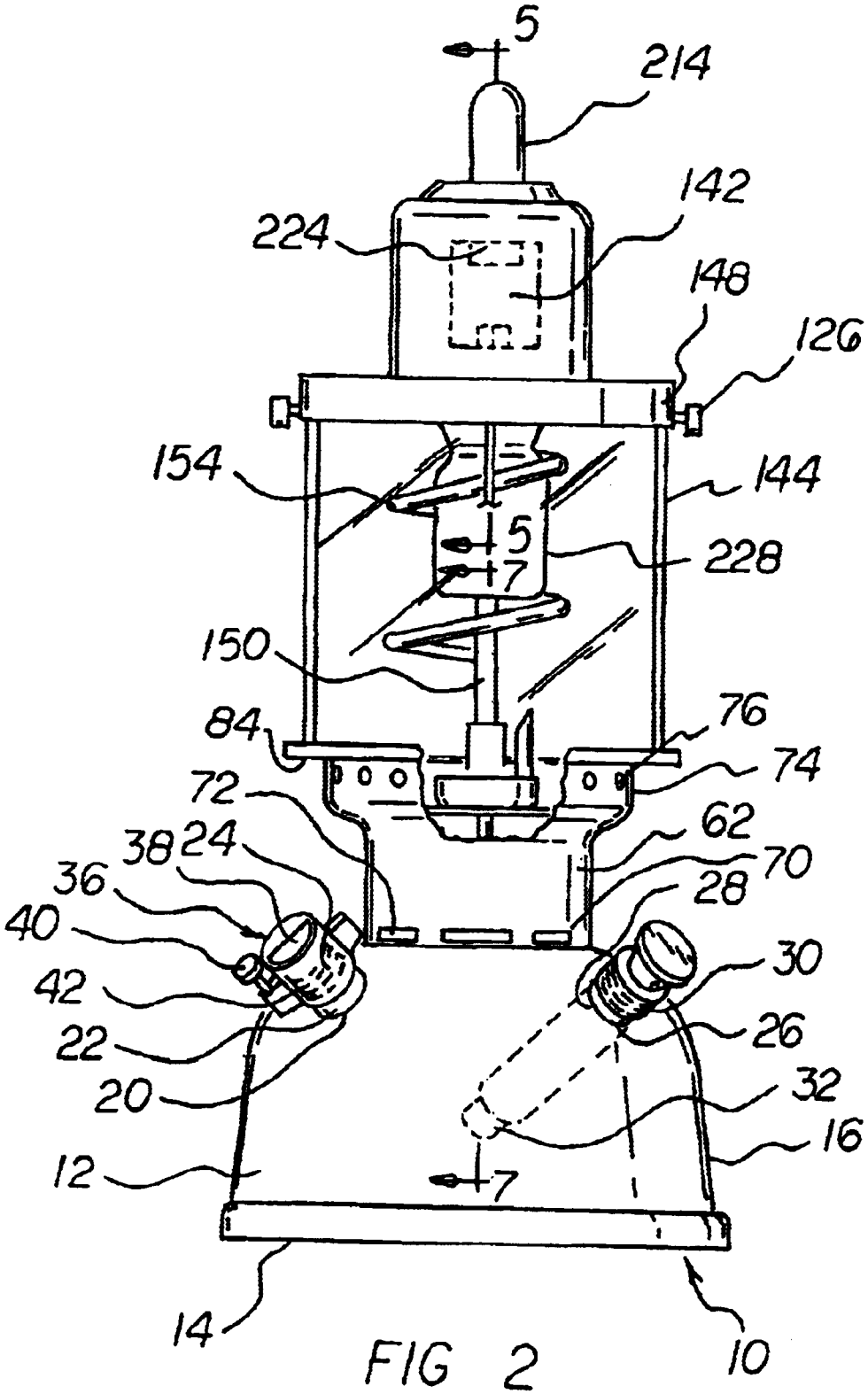
FIG. 2 is a front elevational view taken along line 2—2 of FIG. 1.
Figure 5:
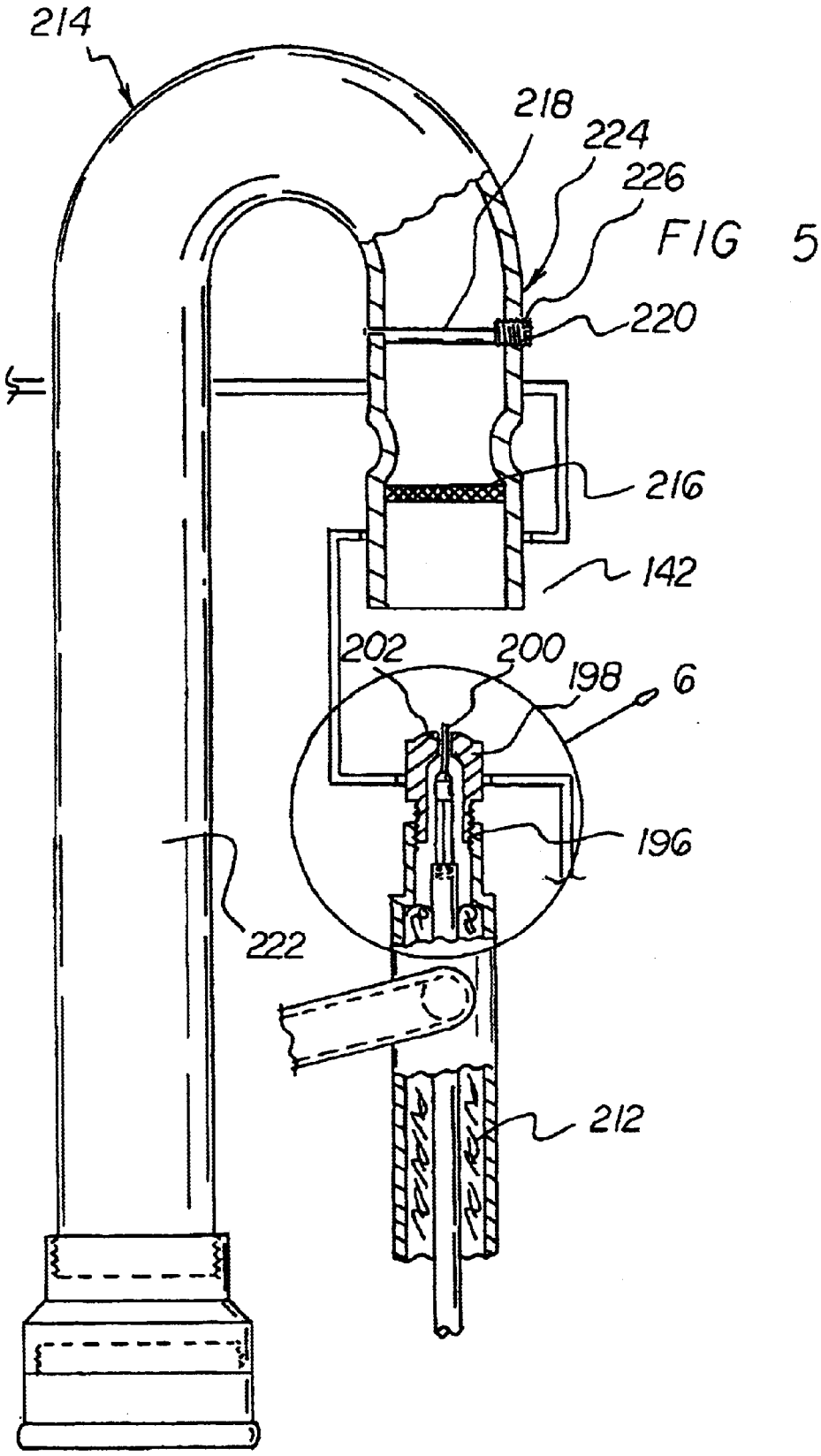
FIG. 5 is a cross sectional view taken along line 5—5 of FIG. 2.
Figure 6:
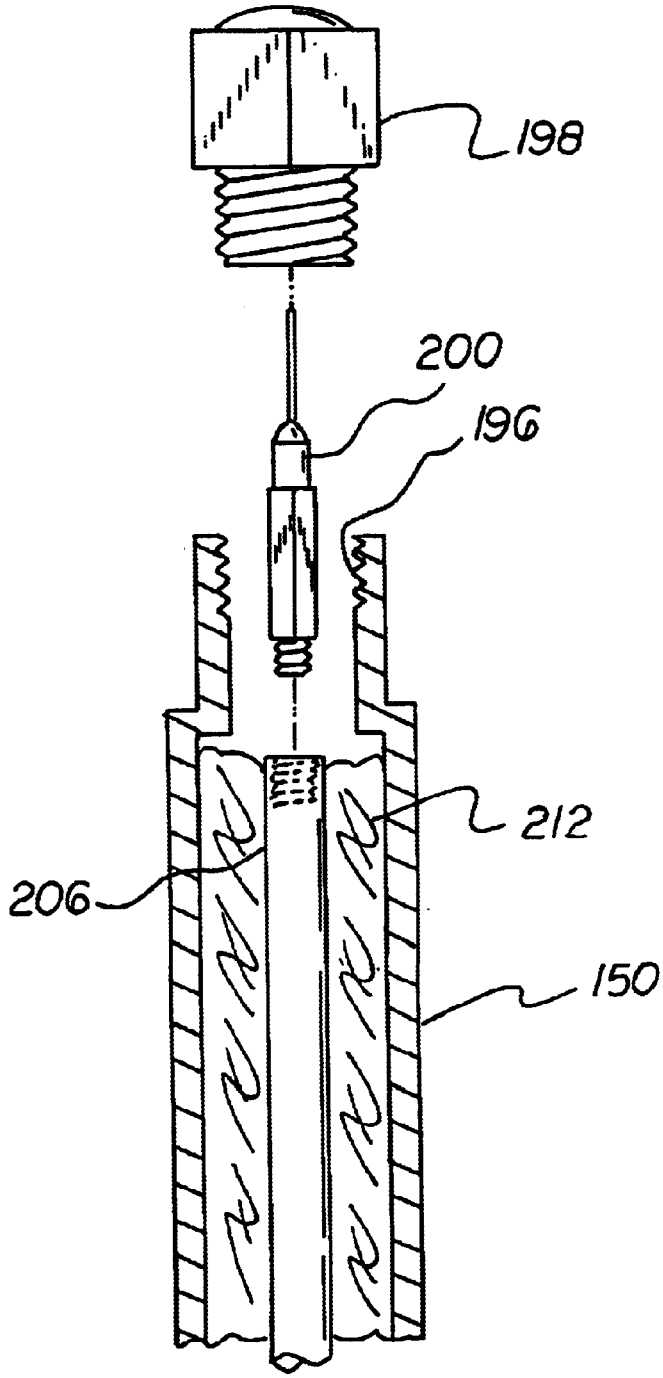
FIG. 6 is an enlarged exploded elevational view taken at circle 6 of FIG. 5.
Figure 7:
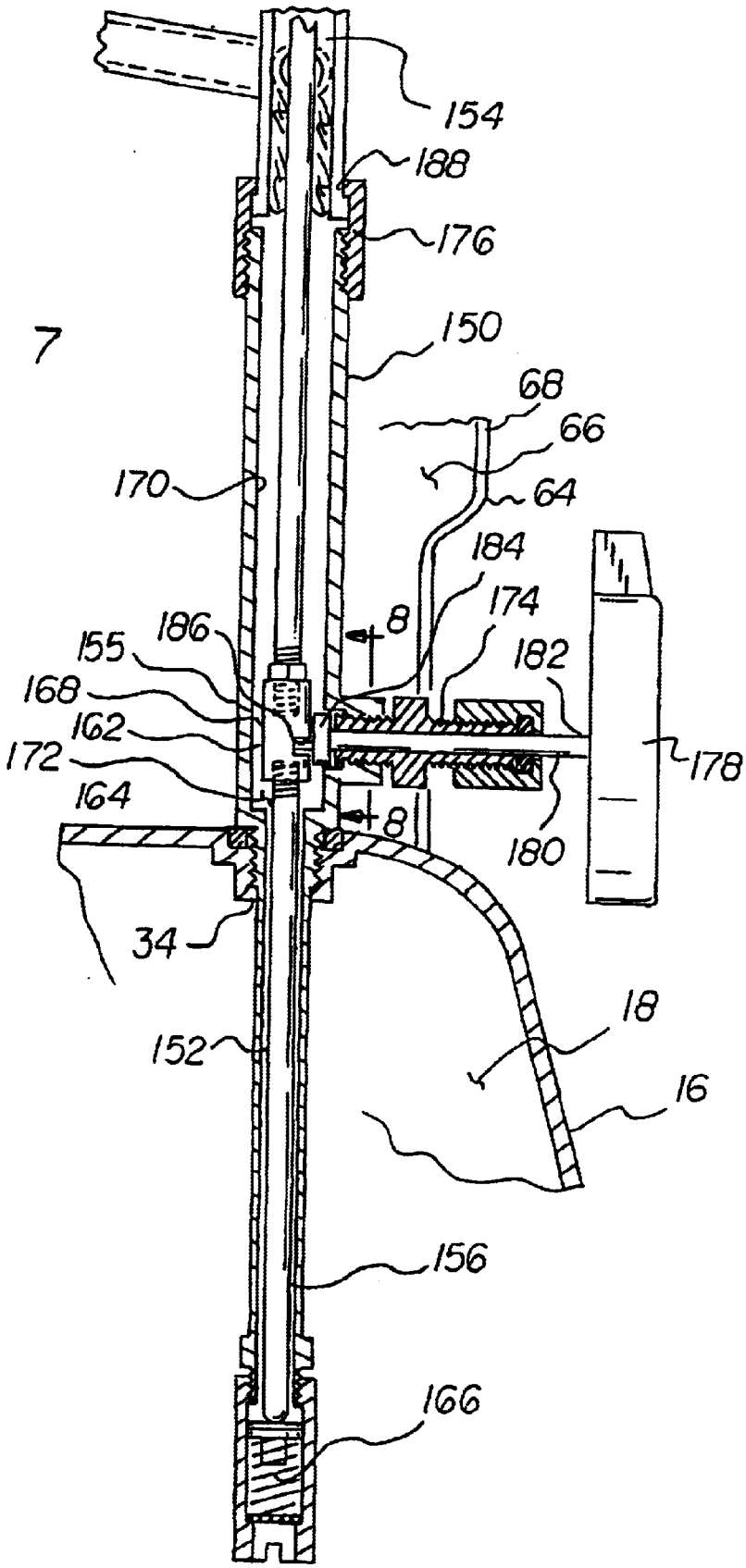
FIG. 7 is a cross sectional view taken along line 7—7 of FIG. 2.
Figure 8:
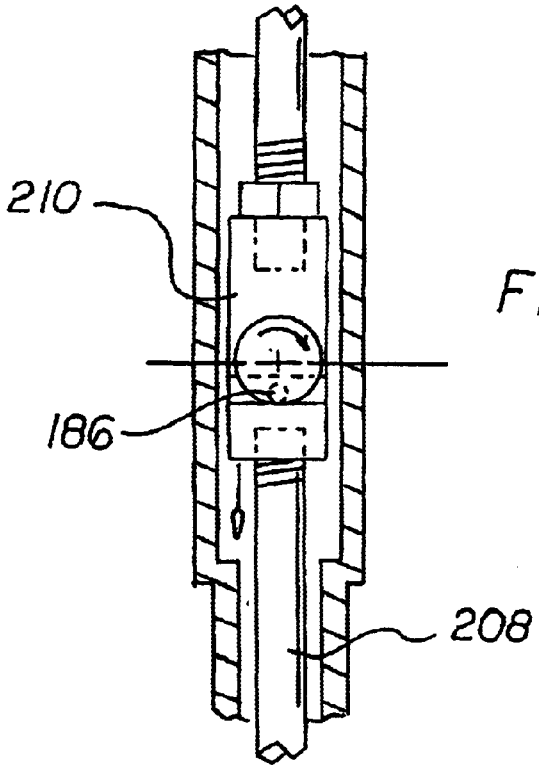
FIG. 8 is a cross sectional view taken along line 8—8 of FIG. 7.
Figure 9:
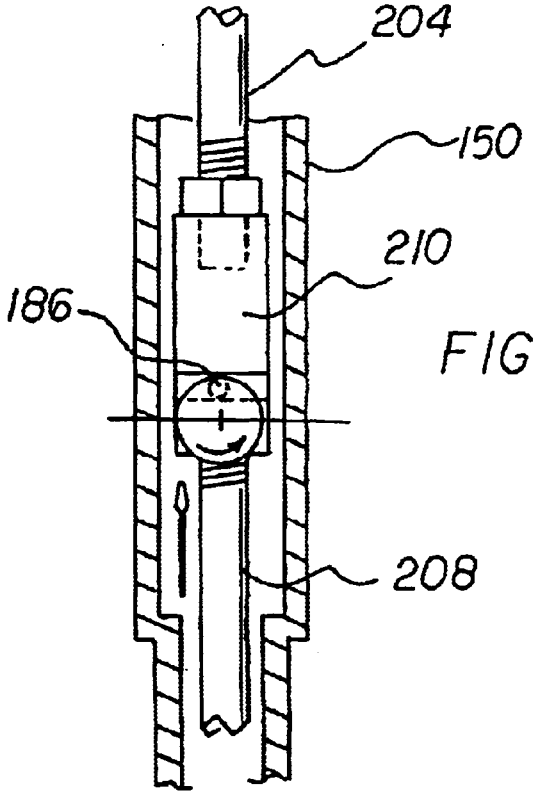
FIG. 9 is a cross sectional view similar to FIG. 8 but illustrating one of the components in a rotated position.
Figure 12:
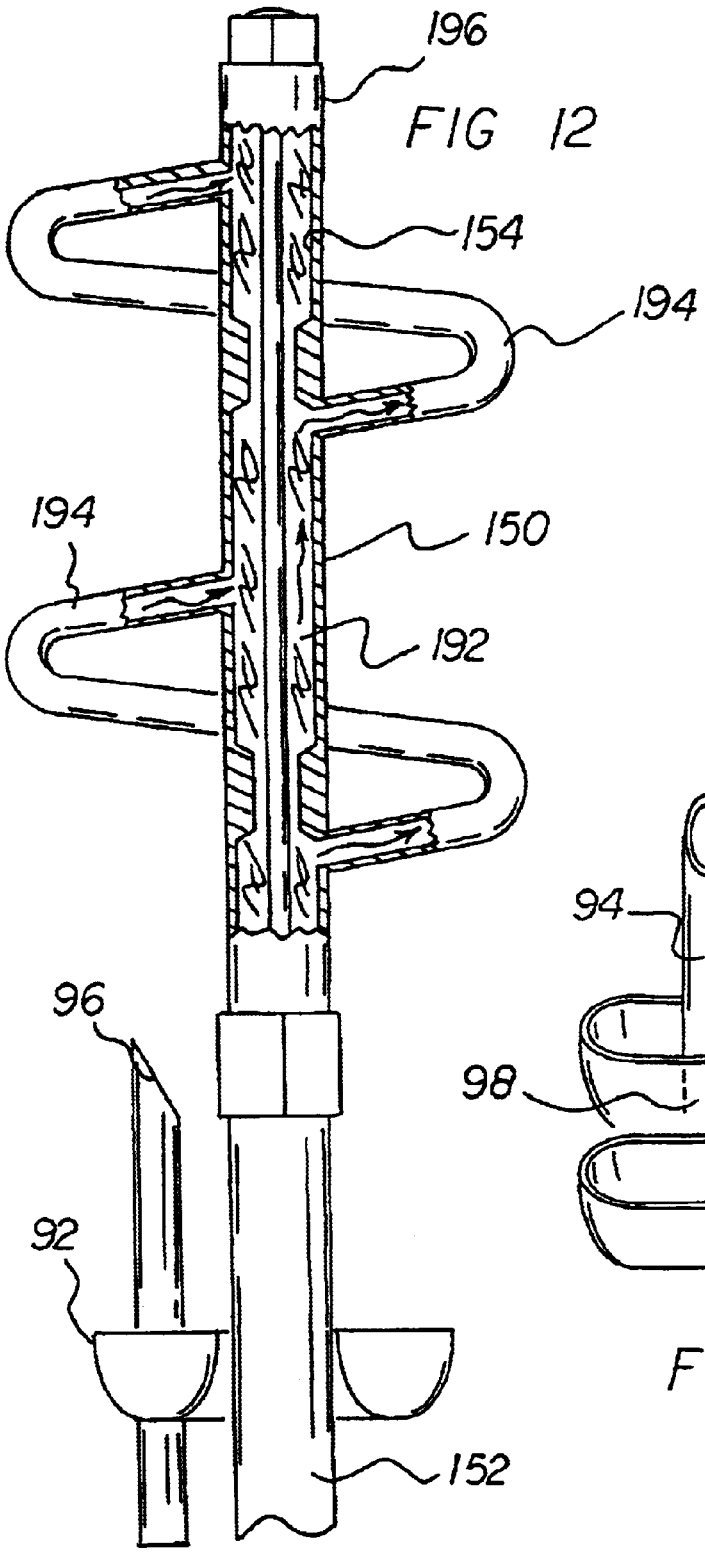
FIG. 12 is a cross sectional view taken along line 11—11 of FIG. 2.
Figure 13:
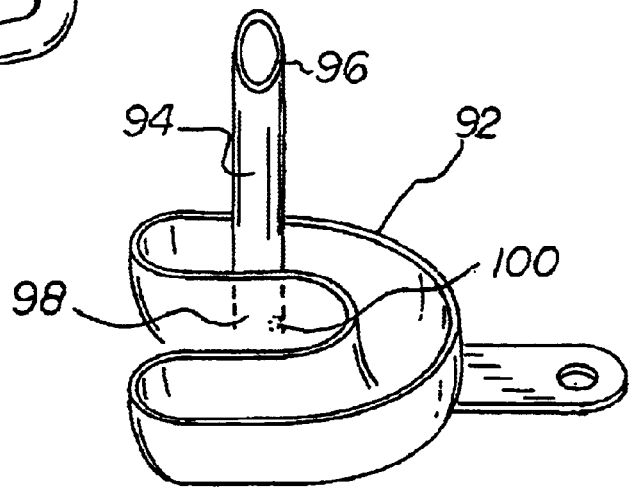
FIG. 13 is a perspective illustration of the ignition bowl of FIGS. 2 and 11.

With reference now to the drawings, and in particular to FIG. 1 thereof, the preferred embodiment of the new and improved lantern and fuel system embodying the principles and concepts of the present invention and generally designated by the reference numeral 10 will be described.

First provided is a fuel tank 12. The fuel tank is fabricated of metal and has a generally hemispherical configuration. The fuel tank has a flat bottom 14 and a hemispherically shaped side wall 16 thereby forming a cavity 18 there within. The side wall has a pressure gauge opening 20 and pressure gauge stub 22 with a male threaded outward end 24. The side wall also has a pump opening 26 and pump stub 28 with a male threaded outward end 30. An associated check valve 32 is contained within the pump stub. There is a vaporizer opening 34 into the cavity of the fuel tank.

Next, a pressure gauge subassembly 36 is provided. The pressure gauge subassembly has a readable indicator 38 and a pressure bleed-off screw 40 and a threaded collar 42 to couple the pressure gauge subassembly to the pressure gauge stub of the fuel tank.

A pump subassembly 44 is next provided. The pump subassembly has a shaft 46 with an upper end 48 and a lower end 50. The upper end has a gripping handle 52. The lower end has a pump portion 54 with a beveled seat 56 and an O-ring 58 associated thereto to provide a seal for pumping. The pump subassembly is positioned in the pump stub of the fuel tank between the cavity of the tank and the end of the pump stub. The shaft of the pump passes through a threaded stub cap 60. The threaded stub cap is coupled to the pump stub of the tank.

A lower skirt 62 is next provided. The lower skirt has a hollow tubular configuration. The lower skirt has an outer surface 64 and an inner surface 66 and a wall thickness there between 68. The lower skirt has a continuous bottom portion 70 of a first diameter. The bottom portion has a valve slot 72. The lower skirt also has a multi-perforated upper portion 74 of a second diameter with a flare 76. The upper portion has an ignition slot 78 and a valve slot 80 there through. The flared upper portion has a lip 82 with a plurality of upwardly directed connecting rod holes there through 84.

Next, a lower skirt cap 86 is provided. The lower skirt cap has a flat round disk-like planar configuration with a plurality of holes 88 there through. The cap is sized to fit within the first diameter of the lower skirt. The cap has a central screw hole 90 for coupling with the tank.

An ignition bowl 92 is next provided. The ignition bowl has a generally U-shaped configuration and an up-pipe 94. The up-pipe has a hollow tube configuration with an upper end 96 and a lower end 98. The upper end is beveled and an aperture 100 is provided into the tube at the lower end of the pipe. The pipe is coupled to the ignition bowl at the lower end and the ignition bowl is coupled to the cap.

Next provided is a safety cover 102. The safety cover has a round flat disc-like configuration. A plurality of holes 104 are provided through the cover. The safety cover has a diameter sized to fit securely within the second diameter of the lower skirt. A Z-shaped upward projection 106 is coupled to the cover. The projection has a notch 108 at an uncoupled end.

A heat resistant glass chimney 110 is next provided. The chimney has a round tubular configuration. The chimney has a first length with an outside diameter sized to be received and securely contained within the inside of the flare of the lower skirt.

Next provided is an upper skirt 112. The upper skirt has a hollow tubular configuration. The upper skirt has an outer surface 114 and an inner surface 116 and a wall thickness 118 there between. The upper skirt has a flared lower portion 120 with a lip 122. The lip has a plurality of downwardly oriented connecting rod holes 124 there through. The upper portion has a plurality of handle coupling threaded studs 126 at opposite sides. The upper portion of the upper skirt has a third diameter larger than the first diameter and smaller than the second diameter. The upper portion has a plurality of upwardly oriented slots 128 there through. The upper skirt has a central opening 130 at the uppermost extent having a diameter of approximately the first diameter.

Next, a lantern top cap 132 is provided. The lantern top cap has a hollow tubular lower portion 134 and an outwardly flared upper portion 136. The upper portion has a flat top 138. The lower portion has a plurality of openings 140 there through. The lower portion has a mixing chamber 142. The lower portion of the lantern top cap couples with the upper skirt.

A plurality of connecting rods 144 are next provided. The connecting rods comprise a shaft. Each end has a male thread 146 and an associated nut 148. The rods are sized to be received into the connecting rod holes of the lower skirt and the upper skirt. The rods couple to the upper and lower skirt with the nuts being tightened on the rods to firmly hold and contain the glass chimney there between.

Next, a vaporizer 150 is provided. The vaporizer has a lower subassembly 152 and an upper subassembly 154. The lower subassembly has an upper end 155 and a lower end 156. The lower end has a tubular configuration and projects downward into the tank cavity through the vaporizer opening in the tank to a point near the bottom of the tank cavity. A valve housing 162 is coupled to the upper end. The upper end has a coupling means 164 to couple the lower subassembly to the tank. The lower end has a check valve 166 at its lowermost extent. The upper end has a T-shaped tubular body 168 with an upper extension 170 and a lower extension 172 and a side end control stub 174 located to protrude through the valve slot of the lower skirt. The upper extension has a flare coupling nut 176. The lower subassembly has a handle 178 and a handle shaft 180. The handle shaft has a handle end 182 and an actuating end 184. The shaft is coupled to the control stub with the handle shaft running the length of the control stub. The shaft has a protrusion 186 at the actuating end.

The upper vaporizer subassembly has a lower flared end 188, a tubular riser 192 and two warming coils 194. The warming coils have a curved tubular configuration and couple at each end of the coil with the tubular riser. The tubular riser has a first internal diameter and a second internal diameter. The first diameter is a larger internal diameter running from the lowermost extent of the upper subassembly to the point midway between the coupling points of the first lower coil where the diameter decreases to the second smaller diameter to a point immediately below the attachment of the first coil. Then the diameter increases to the first larger diameter and runs to a point midway between the coupling points of the second upper coil where the diameter decreases to the second smaller diameter to a point immediately below the attachment of the second coil. Then the diameter increases to the first larger diameter and runs to the uppermost extent of the upper subassembly.

The uppermost extent of the upper subassembly has a female thread 196 and an associated male threaded nipple 198. The nipple has an associated threaded jet needle 200. The nipple has an aperture 202 of between about $^{18}/_{1000}$ inch and $^{24}/_{1000}$ inch there through centrally located and oriented in an upward direction.

A vaporizer shaft 204 is next provided. The vaporizer shaft has an upper shaft 206 and a lower shaft 208 and a shaft connector 210. Each shaft is sized to fit loosely within the tubular body of the valve with the lower shaft threadedly coupling with the shaft connector and the vaporizer lower subassembly check valve and operating the valve as the handle shaft is turned. The upper shaft is threadedly coupled with the connector and the jet needle so that rotation of the knob performs one of the two operations which include the opening of the lower check valve to allow the passage of fuel and the engagement of the needle into the aperture of the nipple.

Next provided is a quantity of steel wool 212. The steel wool is wrapped around the vaporizer shaft.

A J-shaped mixing tube 214 is next provided. The mixing tube has an internal diameter and an external diameter and a wall thickness there between. The tube has an internally coupled wire mesh 216 and an internal rotatably movable baffle plate 218 with an associated rotation shaft 220. The tube has a longer portion 222 and a shorter portion 224. The shorter portion of the mixing tube has a baffle plate aperture 226 with the rotatable baffle located within the internal diameter of the tube with the rotation shaft protruding through the plate aperture. The shorter portion couples with the lantern top cap between about ¾ and 2 inches from the jet aperture of the vaporizer forming a mixing chamber. The longer portion protrudes downward toward the center of the glass chimney.

A mantel 228 is next provided. The mantel is coupled to the short portion of the mixing tube and is suspended within the glass chimney.

Lastly, a quantity of liquid methanol is provided. The methanol is used as a fuel.

In alternate embodiments of the invention, the materials for fabrication may be varied. By way of example, the steel wool wrapped around the shaft may be stainless steel wool. The wire mesh in the J-shaped mixing tube may be stainless steel mesh. The two coils of the vaporizer may be fabricated of a nickel silver alloy and all other metal components may be fabricated of brass. Other suitable materials may be used for fabrication of the various components of the invention.

In alternate embodiments of the invention, a bicycle hand pump fitting is provided in place of the hand pump to allow a user to utilize a bicycle hand pump to pressurize the system and, additionally, a carbon dioxide cartridge is utilized to pressurize the fuel tank, and finally, the top of the lantern is a cooking surface wherein the cooking surface is coupled to the handle studs. Note our prior invention of U.S. Pat. No. 6,439,223, the subject matter of which is incorporated herein by reference.

In another alternate embodiment, a cap to the fuel tank may allow escape of excess pressure within the fuel tank.

The disclosure hereby provides a disclosure of a system which provides an environmentally enhanced fuel, lighting and cooking system comprised of a particular fuel with one oxygenated carbon atom as well as a disclosure of a mantle lantern designed with a particular air fuel ration capability that is designed to vaporize, preheat and partially disassociate the methanol fuel.

In an alternative configuration the methanol is mixed with a 40 percent solution of trimethylamine in 60 percent water to produce a methanol solution which is distasteful so as to prevent the use of methanol as a drinking solution.

Also included is a method for utilizing Methanol as a fuel for lanterns, heaters and stoves. The first step of the method is providing a quantity of methanol. The next step is providing a reservoir for holding the methanol available for use. The next step is providing a pressurizing means of the methanol reservoir to produce a driving force to move the methanol toward the place of ignition. The next step is providing a pre-ignition system for vaporizing the methanol to provide a means for consistent burning. The next step is providing a structural means to vaporize methanol and preheat the vapors allowing for consistent burning. The next step is providing a vapor metering needle valve for the dispersing of vaporized methanol for consistent and continued methanol burning. The final step is providing a mantle for containing the flame from the burning of the vaporized methanol, for ensuring consistent and continued methanol burning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lantern and fuel system for allowing a user to safely and conveniently use a liquid fuel to provide heat and light, comprising in combination:

a fuel tank fabricated of metal having a generally hemispherical configuration with a flat bottom and a hemispherically shaped side wall thereby forming a cavity there within with the side wall having a pressure gauge opening and pressure gauge stub with a male threaded outward end, and a pump opening and pump stub with a male threaded outward end, the stub having an associated check valve contained therein and a vaporizer opening into the cavity of the fuel tank;

a pressure gauge subassembly having a readable indicator and a pressure bleed-off screw and a threaded collar to couple the pressure gauge subassembly to the pressure gauge stub of the fuel tank;

a pump subassembly having a shaft with an upper end and a lower end, the upper end having a gripping handle and the lower end having a pump portion with a beveled seat and an O-ring associated thereto to provide a seal for pumping, the subassembly being positioned in the pump stub of the fuel tank between the cavity of the tank and the end of the pump stub, the shaft of the pump passing through a threaded stub cap, the threaded stub cap being coupled to the pump stub of the tank;

a lower skirt having a hollow tubular configuration having an outer surface and an inner surface and a wall thickness there between with the lower skirt having continuous bottom portion of a first diameter having a valve slot, and a multi-perforated upper portion having a second diameter with a flare, with the upper portion having an ignition slot and a valve slot there through, the flared upper portion having a lip with a plurality of upwardly directed connecting rod holes there through;

a lower skirt cap having a flat round disk-like planar configuration with a plurality of holes there through, the cap being sized to fit within the first diameter of the lower skirt, the cap having a central screw hole for coupling with the tank;

an ignition bowl having a generally U-shaped configuration and a up-pipe, the up-pipe having a hollow tube configuration with an upper end and a lower end, with a beveled upper end and an aperture into the tube at the lower end of the pipe, with the pipe being coupled to the ignition bowl at the lower end and the ignition bowl coupled to the cap;

a safety cover having a round flat disc-like configuration with a plurality of holes there through, the safety cover having a diameter sized to fit securely within the second diameter of the lower skirt, the cover having a Z-shaped upward projection coupled thereto, the projection having a notch at the uncoupled end;

a heat resistant glass chimney having a round tubular configuration having a first length with an outside diameter sized to be received and securely contained within the inside of the flare of the lower skirt;

an upper skirt having a hollow tubular configuration having an outer surface and an inner surface and a wall thickness there between, with the upper skirt having flared lower portion with a lip having a plurality of downwardly oriented connecting rod holes there through, with the upper portion having a plurality of handle coupling threaded studs at opposite sides, with the upper portion of the upper skirt having a third diameter being larger than the first diameter and smaller than the second diameter, the upper portion having a plurality of upwardly oriented slots there through, with the upper skirt having a central opening at the uppermost extent having a diameter of approximately the first diameter;

a lantern top cap having a hollow tubular lower portion and an outwardly flared upper portion with the upper portion having a flat top, the lower portion having a plurality of openings there through, and the lower portion having a mixing chamber, with the lower portion of the lantern top cap coupling with the upper skirt;

a plurality of connecting rods comprising a shaft with each end having a male thread and an associated nut, the rods sized to be received into the connecting rod holes of the lower skirt and the upper skirt, the rods coupling to the upper and lower skirt with the nuts being tightened on the rods to firmly hold and contain the glass chimney there between;

a vaporizer having a lower subassembly and an upper subassembly, the lower subassembly with an upper end and a lower end, the lower end having a top end and a bottom end, the bottom end having a tubular configuration and projecting downward into the tank cavity through the vaporizer opening in the tank to a point near the bottom of the tank cavity, the top end having a valve housing coupled thereto, the bottom end having a coupling means to couple the lower subassembly to the tank, the bottom end having a check valve at its lowermost extent, the top end having a T-shaped tubular body with an upper extension and a lower extension and a side end control stub located to protrude through the valve slot of the lower skirt, with the upper extension having a flare coupling nut, the lower subassembly having a handle and a handle shaft having a handle end and an actuating end, the shaft coupled to the control stub with the handle shaft running the length of the control stub with the shaft having a protrusion at the actuating end, the upper vaporizer subassembly having a lower flared end with an associated coupling nut and a tubular riser and two warming coils, the warming coils having a curved tubular configuration and coupling at each end of the coil with the tubular riser, with the tubular riser having a first internal diameter and a second internal diameter with the first larger internal diameter running from the lower most extent of the upper subassembly to the point midway between the coupling points of the first lower coil where the diameter decreases to the second smaller diameter to a point immediately below the attachment of the first coil then the diameter increasing to the first larger diameter and running to a point midway between the coupling points of the second upper coil where the diameter decreases to the second smaller diameter to a point immediately below the attachment of the second coil then the diameter increasing to the first larger diameter and running to uppermost extent of the upper subassembly, with the upper most extent of the upper subassembly having a female thread and an associated male threaded nipple, the nipple with an associated threaded jet needle, the nipple having an aperture of between about $^{18}/_{1000}$ inch and $^{24}/_{1000}$ inch there through centrally located and oriented in an upward direction;

a vaporizer shaft having an upper shaft and a lower shaft and a shaft connector with each shaft sized to fit loosely within the tubular body of the valve with the lower shaft threadedly coupling with the shaft connector and the vaporizer lower subassembly check valve and operating the valve as the handle shaft is turned, and the upper shaft threadedly coupled with the connector and the jet needle so that rotation of the knob performs one of the two operations which include the opening of the lower check valve to allow the passage of fuel and the engagement of the needle into the aperture of the nipple, a quantity of steel wool wrapped around the vaporizer shaft;

a J-shaped mixing tube having an internal diameter and an external diameter and a wall thickness there between, the tube having an internally coupled wire mesh and an internal rotatably movable baffle plate with an associated rotation shaft, the tube having a longer portion and a shorter portion, the shorter portion of the mixing tube having a baffle plate aperture with the rotatable baffle located within the internal diameter of the tube with the rotation shaft protruding through the plate aperture, the shorter portion coupling with the lantern top cap between about ¾ and 2 inches from the jet aperture of the vaporizer forming a mixing chamber, the longer portion protruding downward toward the center of the glass chimney;

a mantel coupled to the short portion of the mixing tube and suspended within the glass chimney; and a quantity of liquid methanol to be used as a fuel.

2. A lantern and fuel system, comprising in combination:

a fuel tank;

a pressure gauge subassembly coupled to the fuel tank;

a pump subassembly coupled to the tank;

a lower skirt coupled to the tank;

a lower skirt cap coupled to the tank;

an ignition bowl having an up-pipe coupled to the tank;

a safety cover having a Z-shaped upward projection coupled to the lower skirt;

an upper skirt coupled to the glass chimney;

a heat resistant glass chimney coupled to the lower skirt and the upper skirt;

a lantern top cap having a mixing chamber, coupled to the upper skirt;

a plurality of connecting rods to firmly hold and contain the glass chimney there between the upper skirt and the lower skirt;

a vaporizer having two warming coils and a nipple;

a vaporizer shaft;

a quantity of steel wool wrapped around the vaporizer shaft;

a J-shaped mixing tube having a wire mesh and a baffle plate coupled to the lantern top cap;

a mantel coupled to the mixing tube; and a quantity of liquid methanol to be used as a fuel.

3. A lantern and fuel system as described in claim 2 wherein the liquid fuel is methanol.

4. A lantern and fuel system as described in claim 2 wherein the fuel tank has a check valve which allows ambient pressurization of the fuel tank.

5. A lantern and fuel system as described in claim 2 wherein the lantern and fuel system further comprises a bicycle hand pump fitting in place of the hand pump to allow a user to utilize a bicycle hand pump to pressurize the system.

6. A lantern and fuel system as described in claim 2 wherein a carbon dioxide cartridge is utilized to pressurize the fuel tank.

7. A lantern and fuel system as described in claim 2 wherein the top of the lantern is a cooking surface being coupled to the handle studs.

8. A lantern and fuel system as described in claim 2 wherein the steel wool wrapped around the shaft is stainless steel wool.

9. A lantern and fuel system as described in claim 2 wherein the wire mesh in the J-shaped mixing tube is stainless steel mesh.

10. A lantern and fuel system as described in claim 2 wherein the two coils of the vaporizer are fabricated of a nickel silver alloy and all other metal components are fabricated of brass.

* * * * *